US008523099B2

(12) United States Patent
Kipping et al.

(10) Patent No.: US 8,523,099 B2
(45) Date of Patent: Sep. 3, 2013

(54) METHOD AND DEVICE FOR WINDING METAL STRIP MATERIAL

(75) Inventors: Matthias Kipping, Herdorf (DE); Rolf Franz, Kreuztal (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 196 days.

(21) Appl. No.: 13/001,457

(22) PCT Filed: Jun. 25, 2009

(86) PCT No.: PCT/EP2009/004598
§ 371 (c)(1),
(2), (4) Date: Jan. 21, 2011

(87) PCT Pub. No.: WO2009/156159
PCT Pub. Date: Dec. 30, 2009

(65) Prior Publication Data

US 2011/0107810 A1 May 12, 2011

(30) Foreign Application Priority Data

Jun. 27, 2008 (DE) ..... 10 2008 030 145

(51) Int. Cl.
*B65H 18/10* (2006.01)
*B65H 75/24* (2006.01)

(52) U.S. Cl.
USPC ..... 242/571; 242/571.1; 242/571.2; 279/2.07; 72/66; 72/371; 72/478

(58) Field of Classification Search
USPC ..... 242/571, 571.1, 571.2; 279/2.07, 279/2.08; 72/371, 478, 66
See application file for complete search history.

(56) References Cited

U.S. PATENT DOCUMENTS

| | | | | |
|---|---|---|---|---|
| 2,630,278 | A * | 3/1953 | Herman | 242/575 |
| 3,273,817 | A | 9/1966 | Damiron | |
| 3,414,210 | A | 12/1968 | Gaudin | |
| 4,078,739 | A * | 3/1978 | Noe | 242/573.8 |
| 4,771,963 | A * | 9/1988 | Gattrugeri | 242/571.2 |
| 5,372,331 | A * | 12/1994 | Miller et al. | 242/571.2 |
| 5,445,342 | A * | 8/1995 | Miller et al. | 242/571.2 |
| 6,079,662 | A * | 6/2000 | Miller et al. | 242/571.2 |
| 6,883,746 | B2 * | 4/2005 | Murachi et al. | 242/571.1 |

FOREIGN PATENT DOCUMENTS

| | | |
|---|---|---|
| AT | 219940 | 2/1962 |
| DE | 1777229 | 4/1971 |
| DE | 2620926 | 11/2007 |
| EP | 0017675 B1 | 4/1979 |
| EP | 0017675 A1 | 10/1980 |
| FR | 2797002 A | 2/2001 |
| JP | 58179514 A | 10/1983 |

* cited by examiner

*Primary Examiner* — David B Jones
(74) *Attorney, Agent, or Firm* — Lucas & Mercanti, LLP; Klaus P. Stoffel

(57) ABSTRACT

The invention concerns a method and a coiler mandrel for coiling metal strip (110), wherein the coiler mandrel (100) comprises a mandrel body (120), a plurality of radially expandable segments (115) arranged around the mandrel body (120), and a plurality of hydraulic cylinders (116) by which the segments (115) can be moved in the radial direction. To be able to coil the metal strip with a circular coil eye even when the friction varies in the individual cylinders, the invention proposes that each cylinder (116) of the plurality of cylinders be individually controlled.

17 Claims, 6 Drawing Sheets

METHOD AND DEVICE FOR WINDING METAL STRIP MATERIAL

The present application is a 371 of International application PCT/EP2009/004598 filed Jun. 25, 2009, which claims priority of DE 2008 030 145.0, filed Jun. 27, 2008, the priority of these applications is hereby claimed and these applications are incorporated herein by reference.

BACKGROUND OF THE INVENTION

The invention concerns a method for coiling metal strip with

- a coiler mandrel with a mandrel body,
- a plurality of radially expandable segments arranged around the mandrel body, and
- a plurality of hydraulic cylinders by which the segments can be moved in the radial direction.

The invention also concerns a device for coiling metal strip.

In rolling mills, metal strip is shaped into sheets or into wound coils to allow transport and further processing of the strip within the mill or at the customer's site. Metal coils are produced by radial coiling of straight metal strip in a coiling installation. The metal strip is a product of a hot strip mill or cold strip mill. This means that the temperature can be less than 100° C. or greater or much greater than 100° C., depending on the type of mill and heat treatment.

Coiling installations operate basically in such a way that the metal strip is guided onto a rotating mandrel, the so-called coiler mandrel. The metal strip is guided around the coiler mandrel by guide elements, such as deflecting shells, guide rollers, belt conveyors, etc., which are arranged around the longitudinal axis of the coiler mandrel in such a way that they can move radially. When, after the start of coiling, the coiler mandrel has been enabled to develop tension in the metal strip, the aforementioned guide elements are moved away, for example, swiveled away, from the metal strip into a neutral position. When necessary, e.g., when the metal strip threatens to lose its tension as it exits, e.g., the rolling stand or the driving equipment of the coiling installation, the guide elements can be swung back in. This prevents the coil from losing its shape or cracking.

A prior-art coiling installation consists, for example, as shown in FIG. 1 and FIG. 2, of:

- a motor 1 and a transmission 3, for driving the coiler mandrel,
- a clutch 4, which connects the drive with the mandrel,
- a rotating or stationary hydraulic cylinder 5, which is connected with an expanding bar 13 or expander unit,
- a displacement measuring system for measuring the piston displacement (not shown),
- a rear mandrel bearing 6 and a front mandrel bearing 7,
- a coiling section 8,
- a mandrel body 12, which supports the expanding bar 13 and a pressure member 14,
- segments 15, which are held with tongues (not shown) of the mandrel body 12 and are moved in or out by means of the pressure member 14, and
- a mandrel step bearing 9.

The functioning of the prior-art coiler mandrel is shown in greater detail in FIG. 2. During coiling, the metal strip 10 wraps spirally around the coiler mandrel to form windings 11. Coiler mandrels are able to increase or decrease (to expand or contract) their outside dimension 8.1 in the coiling section. This function is realized by moving the outer segments 15 in the radial direction. To start the winding operation, the metal strip 10 is guided around an expanded coiler mandrel. After the metal strip 10 has been coiled into a metal coil, it must be released from the coiler mandrel to allow it to be removed. To this end, the coiler mandrel is contracted, i.e., the segments 15 are moved towards the longitudinal axis of the coiler mandrel, thereby reducing the outside dimension 8.1 of the coiling section 8. The coiler mandrel releases the coil.

The expansion mechanism is illustrated in FIG. 2. The expanding bar 13 has at least one oblique plane 13.1 and preferably several. The movement 13.2 of the expanding bar 13 left or right in the axial direction of the coiler mandrel causes the oblique plane 13.1 to be moved, and the pressure member 14 is raised or lowered in the radial direction and in turn raises or lowers the radially more outwardly located segment 15. Since the segments 15 of the coiling section 8 expand and contract as uniformly as possible and must absorb the forces that arise, several oblique planes are arranged, preferably uniformly, over both the circumference and the length of the coiling section 8. The expanding bar 13 is coupled with the hydraulic cylinder 5, from which it receives a translational drive or a holding force.

A common feature of previously known coiler mandrels is that the segments 15 are moved by means of an oblique plane 13.1. In this regard, it is not necessary that a pressure member 14 takes on the transmission of the force and movement. Oblique planes 13.1 are often joined to the segments 15, so that there is direct contact between the expanding bar 13 and segment 15. In order to hold the segments 15 in the coiler mandrel during rotation against centrifugal force and gravity, brackets, for example, are provided, which are rotatably supported in the expanding bar 13 and rotatably supported in the segments 15. In a different embodiment, the segments 15 can be held in the coiler mandrel by means of guides, against which the segments 15 rest.

Since the expanding bar 13 is mounted inside the mandrel body 12, an opening is provided in the mandrel step bearing 9 for this purpose. The expanding bar 13 is inserted into the mandrel body 12 through this opening. To be able to link the step bearing to the mandrel body 12, a joint 9.1 is provided here. This is preferably realized as a bolted joint.

A coiler mandrel in a hot strip mill can usually be used for coiling metal strip with thicknesses of 0.8 mm to 25.4 mm. In this connection, the strengths can vary between low, e.g., for low carbon, and high, e.g., for pipe grades (X80, X100, etc.). Of course, in a coiler mandrel according to the prior art described above, no systematic and precise force setting can be made. The reason for this is the oblique planes, which, as a result of their high and nonreproducible friction, bring about a corresponding hysteresis. The difficulty of the nonreproducibility of the friction is based on the presence of wear on the pressure member, on the segments and on the expanding bar. The wear takes the form of removal of material, deformation, changes in surface roughness, etc. A complicating factor is that the lubricating conditions can be unfavorable, since, for example, grease cannot emerge due to high pressure on the grease discharge borehole, or the grease burns or carbonizes when high temperatures develop. It is also possible for the grease to be washed away by cooling water. The penetration of dirt and scale also has an unfavorable effect on the sliding surfaces if the dirt and scale contaminate the grease and/or get between the sliding or friction surfaces. The consequence of deformation and removal of material is that the segments are no longer able to move up to the desired outside dimension, i.e., the maximum coiler mandrel diameter and the horizontal position of the segments can no longer be attained. The design of the joint 9.1 for the mandrel step bearing is the deciding factor for the loading capacity of the coiler mandrel. Basically, the joint 9.1 (or point of separation) represents a weak point.

Austrian Patent 219 940 discloses a prior-art device for controlling winding drums, with a drum member and two tightening segments pivotable thereon, on which acts a row of hydraulically operated pistons, pins, or the like, which spread the segments apart. The pistons, pins or the like are supported in the drum member or in a part that is directly or indirectly connected with it. A row of hydraulically operated pistons, pins, or the like acts on each of the two tightening segments between its free end that faces the other tightening segment and its pivoted part. In addition, a thrust segment is provided, which is placed between the tightening segments that have been spread apart.

Other coiler mandrels that have piston-cylinder units for the spreading of segments are disclosed by the documents DE 26 20 926 A1, U.S. Pat. No. 3,273,817, and U.S. Pat. No. 3,414,210.

EP 0 017 675 B1 discloses an expandable coiler mandrel with a core, with a number of radially expandable segments arranged around the core, and for each segment, with a number of hydraulic piston-cylinder units, by which the segments can be moved radially. The segments are connected with the hydraulic units in the core. In addition, the segments are fastened to the pistons of the hydraulic units. The pistons are annular and mounted around pins, which in turn are fastened to the core and have heads for limiting the radial upward movement of the segments. First and second chambers for hydraulic fluid are provided on the radial inside and outside of the pistons, so that the hydraulic units can be actuated to move the segments in and out. The first chambers of the hydraulic units (for moving the segments out) are connected with a number of hydraulic cylinders, whose pistons are arranged for movement together, so that the first chambers assigned to a single segment are each connected with at least two different hydraulic cylinders.

A disadvantage of the previously known coiler mandrels is that the radially extensible cylinders are all hydraulically coupled with one another, i.e., they have a common supply line (pressure line) for at least two, but usually more than two, cylinders. In the known coiler mandrels, only the terminal positions of the cylinders (completely expanded or completely contracted) are ever moved into. Further expansion of the segments from an initial expanded position (intermediate position of the segments) is not possible, because the friction or the load differs from cylinder to cylinder. The cylinders would thus produce variable extension of the segments, and the eye of the coil, which is formed by the outer contour of the coiler mandrel, would not be cylindrically formed. Noncircular formation of this type leads to problems during the further handling of the coil.

SUMMARY OF THE INVENTION

Therefore, the objective of the invention is to specify a method by which the aforementioned disadvantages are avoided. A further objective of the invention is to specify a device for coiling metal strip.

The objective of the invention with respect to a method is achieved by virtue of the fact that each cylinder of the plurality of cylinders is individually controlled.

The claimed individual control of the individual cylinders has the advantage that it makes it possible to set each individual cylinder to setpoint values that are individually predetermined for each cylinder. The claimed individual control of the individual cylinders also allows individual resetting of the individual cylinders to new predetermined setpoint values starting from an already initially expanded coiler mandrel. In particular, it is then also possible to predetermine any desired setpoint values that lie between system-related maximum possible setpoint values (terminal values).

In a first embodiment of the invention, all of the cylinders and balancing cylinders of the coiler mandrel are individually controlled to the same predetermined position, especially the same radial distance from the longitudinal axis of the coiler mandrel, even when the friction or the loading is meant to differ from cylinder to cylinder. This control advantageously ensures that all of the cylinders extend the same radial distance and that the eye of the coil is cylindrically or circularly formed.

As an alternative to automatic position control, the cylinders can also be pressure-controlled or force-controlled. By setting or adjusting each cylinder of the plurality of cylinders of the coiler mandrel to the same predetermined force, it is likewise possible to realize a symmetrical, especially circular, coil eye.

The further expansion is accomplished by automatically controlled pressure and/or automatically controlled positioning of the segments, where the correlation of tensile force in the metal strip to the expansion of the coiler mandrel is likewise produced by setting the motor torque. The coordination of these two quantities, i.e., tensile force in the metal strip and expansion force in the coiler mandrel, guarantees a reliable start of coiling and with the use of the minimal expansion force, it helps minimize damage of the metal strip and maximize the service life of the components of the coiler mandrel.

The objective of the invention is also achieved by a device for coiling metal strip in accordance with claim 5. The advantages of this device are the same as the advantages described above with reference to the method. A synchronizing device serves to ensure, if so desired, that the same setpoint values are predetermined in each case for the automatic control of the individual cylinders.

Further advantages of the method and device claimed here are objects of the corresponding dependent claims.

The coiler mandrel of the invention makes it possible to dispense with a relatively large expanding cylinder, an expanding bar, pressure members, the joint, and the borehole in the mandrel body.

A specific embodiment of the invention is explained in greater detail below with reference to highly schematic drawings.

DETAILED DESCRIPTION OF THE INVENTION

Figure 3:
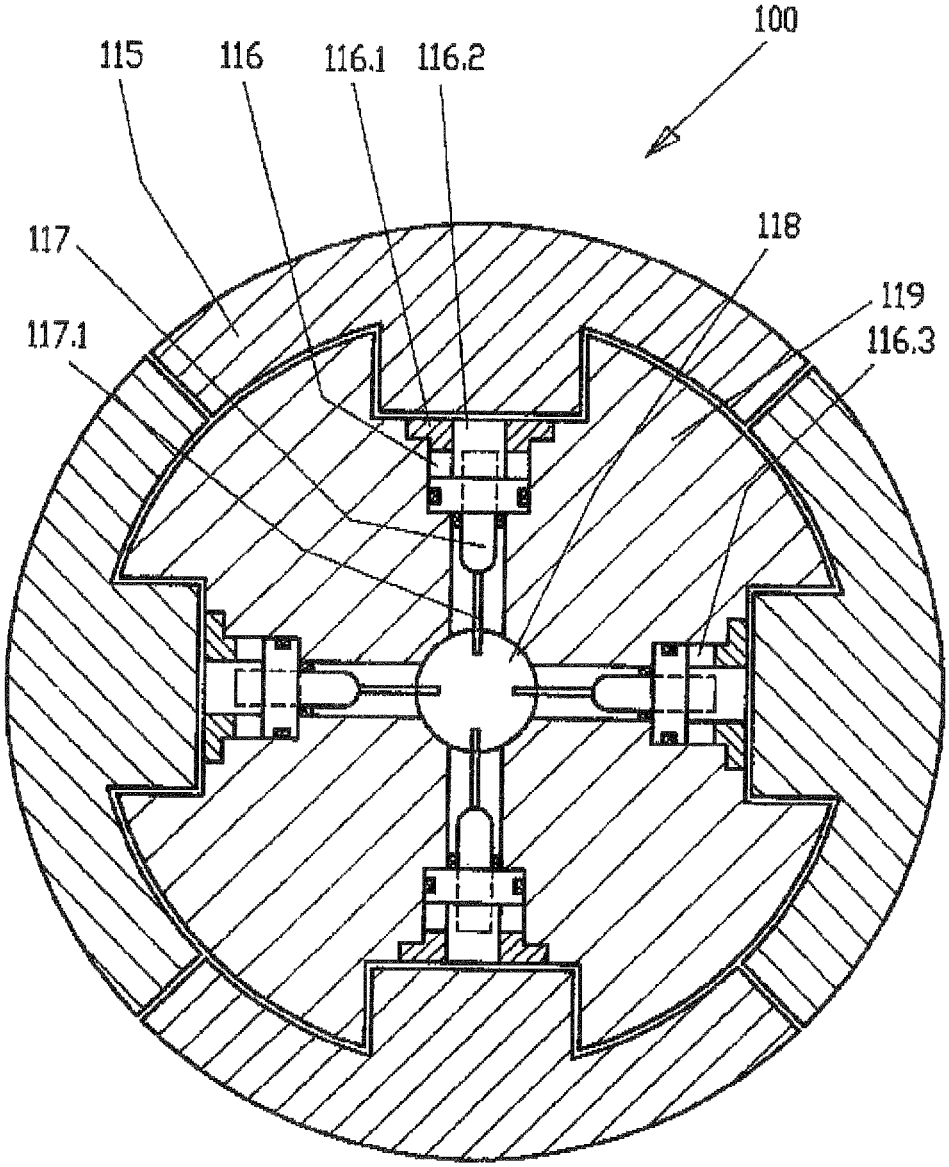
FIG. 3 shows a cross-sectional view of a coiler mandrel according to the invention.
Figure 4:
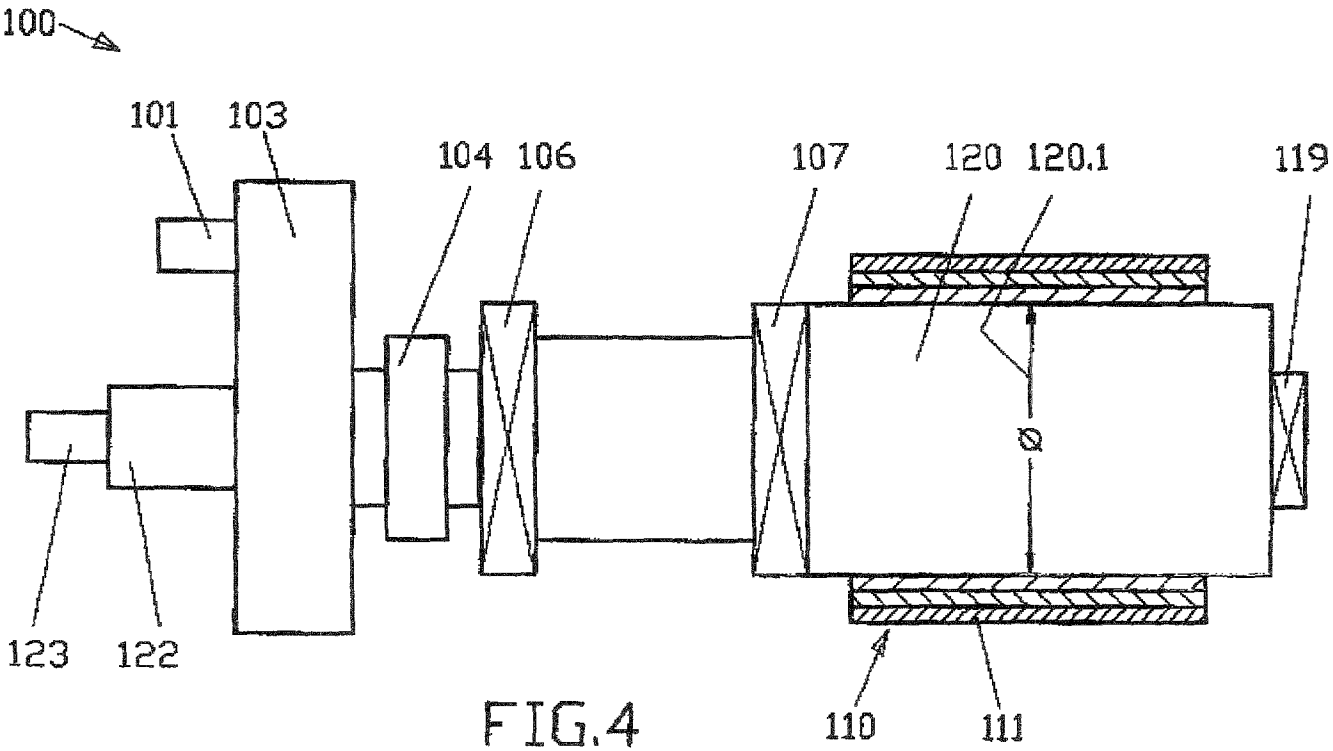
FIG. 4 shows a longitudinal partial section of a coiler mandrel according to FIG. 3.
Figure 5:
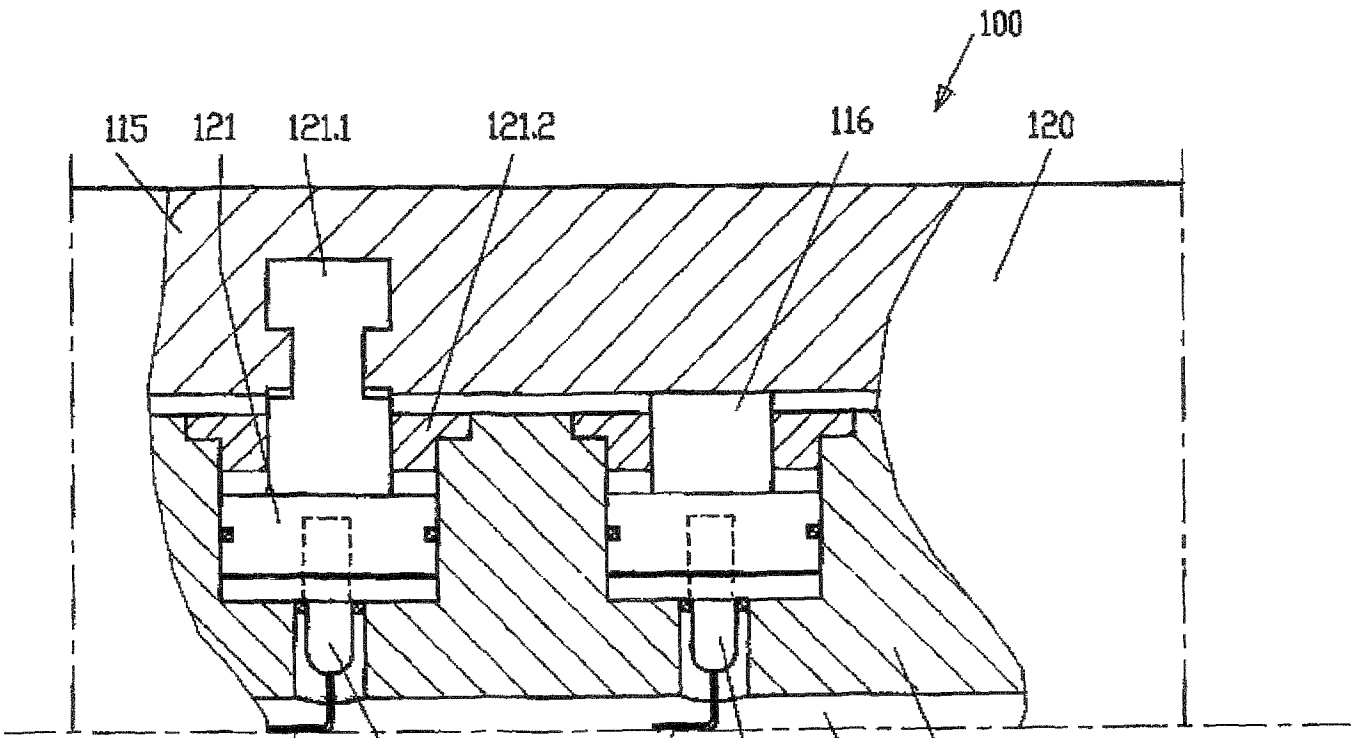
FIG. 5 shows a longitudinal partial section of a coiler mandrel according to FIG. 3 with an expanding segment, cylinder, mandrel body, and position sensor.

As shown in FIGS. 3 to 5, a coiler mandrel 100 of the invention is formed in the coiling section 120 with cylinders 116 and balancing cylinders 121. The cylinders 116 and balancing cylinders 121 move and/or hold the segments 115. The cylinders 116 and balancing cylinders 121 are operated, for example, hydraulically. Besides oil, other media, e.g., grease, can be used. The cylinders 116 are responsible for transmitting and/or producing the expansion force and the movement of the segments 115. As shown in the drawings, the cylinders 116 with their cylinder covers 116.1 and cylinder pistons 116.2 are set directly in the mandrel body 119. However, it is also conceivable for a complete cylinder 116 to be mounted as a unit in the coiler mandrel 100. Preferably, each cylinder 116 is provided with a position sensor 117, so that the exact position of the cylinder piston 116.2 can be determined and controlled by open-loop or closed-loop control. The cables 117.1 of the position sensors 117 are carried by the cable conduit 118 to the rotary transformer 123 (see FIG. 4) and from there to the open-loop control, closed-loop control and/or evaluation unit (not shown). The medium supply line 122 supplies medium to the cylinders 116 and balancing cylinders 121.

The medium supply line 122 supplies the cylinders 116 and balancing cylinders 121 with the necessary media and the mandrel body 119 with a cooling and/or cleaning liquid, such as water, for cooling and cleaning. In addition, the coiler mandrel 100 is supplied with lubricant at points of lubrication via the medium supply line 122. Water for cooling and cleaning is likewise conveyed by the medium supply line 122 to the point of consumption on the coiler mandrel 100. The rotary transformer 123 supplies the position sensor 117 with voltage or current.

Analogously to the cylinder 116, the balancing cylinder 121 with its cylinder piston 121.1 and its cylinder cover 121.2 is mounted directly or as a complete replaceable unit in the mandrel body 119. The balancing cylinder 121 has the function of holding the segment or segments 115 against centrifugal force and gravity in such a way that there is always contact between the cylinder piston 116.2 and the segment 115. This cylinder 121 can also be equipped with a position sensor 117. Another design provides for the cylinder 121 to be driven or automatically controlled to a predetermined force with the aid of a pressure sensor, so that a position sensor 117 can be dispensed with.

The cylinders 116 and the balancing cylinders 121 are automatically controlled or regulated by pressure sensors, which measure the pressure in the supply or discharge lines, and/or by the position sensors 117. The balancing cylinder 121 is designed in such a way that it preferably forms a positive-locking connection with the segment 115. Another embodiment consists in a frictional connection.

To calibrate the outside diameter of the coiler mandrel 100 with the segments 115, at least two calibrating rings spaced a predetermined distance apart are pushed on in the direction of the longitudinal axis and positioned. The outside diameter and the position sensors are In addition, the horizontal position of the segments 115 can be determined with suitable measuring or testing devices. The wear of the segments 115 can be equalized by means of the cylinders 116.

Figure 6:
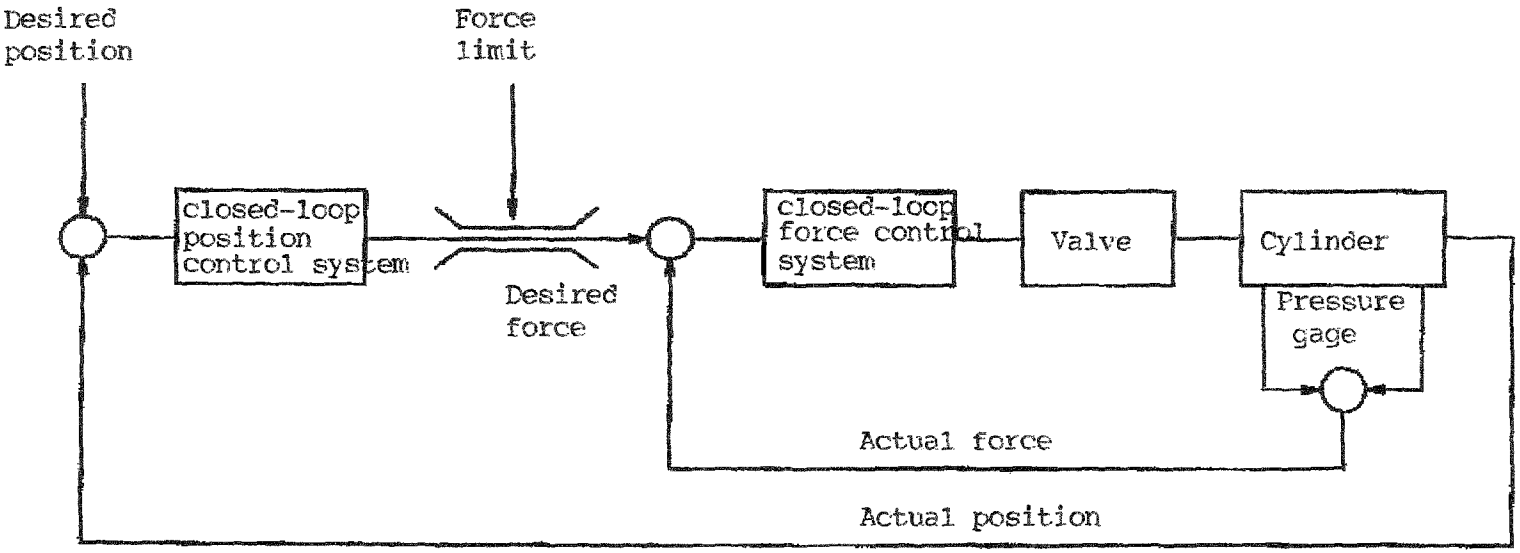
FIG. 6 shows the closed-loop control system of the device.

FIG. 6 shows an example of a closed-loop control system for the device, with which each individual cylinder of the device is individually controlled. The illustrated closed-loop control system involves automatic position control with a subordinate force control system. The superordinate position control system causes all cylinders of the coiler mandrel to be automatically controlled to the same set position, i.e., the same radial distance from the longitudinal axis of the coiler mandrel. In this connection, the subordinate closed-loop force control system guarantees that a set force individually predetermined for the cylinders is maintained and, especially, is not exceeded.

Alternatively or additionally, the automatic control device of the invention for each cylinder can have an individual force control system with a subordinate position control system. The forces with which the cylinders press against the coiled strip are then automatically controlled to predetermined, preferably equal, forces by means of the superordinate force control system. At the same time, the subordinate position control system guarantees that a predetermined set position of the cylinders is maintained in the force control system.

In both automatic control mechanisms, i.e., automatic position control with subordinate automatic force control or automatic force control with subordinate automatic position control, a force limiter can be provided, so that, in the event of failure of the force control system, it is possible to prevent a predetermined maximum force from being exceeded and thus to avoid possible damage to the coiler mandrel or the coiled strip. If both automatic control mechanisms are available, it may be advisable, depending on the operating situation, to switch between the two mechanisms. Automatic position control, preferably with subordinate automatic force control, is used especially during startup of the coiler mandrel, i.e., at the beginning of the coiling operation. Thereafter, i.e., during a steady-state coiling operation, i.e., after a pair of windings has already been coiled, it is advisable to switch to superordinate automatic force control with subordinate automatic position control.

With the two aforementioned automatic control mechanisms, the position and the working pressure can be individually selected/controlled as desired within the system limits. This makes it possible to coil the metal strip on a coiler mandrel that has been given an initial expansion. This means that during the initial phase of the coiling operation, the coiler mandrel further increases its diameter—after a certain number of windings have been coiled—if the windings are loose or it is desired that tension be developed as early as possible.

The device of the invention does not have a main cylinder but rather a rotary supply system, which is able to supply each individual cylinder with the necessary fluid, preferably at high pressure. The automatic control system guarantees that the cylinders 116 move the segments 115 synchronously, so that these are always moved in a horizontal position. This prevents tilting and jamming of the segments 115, so that operating reliability is always ensured.

Figure 1:
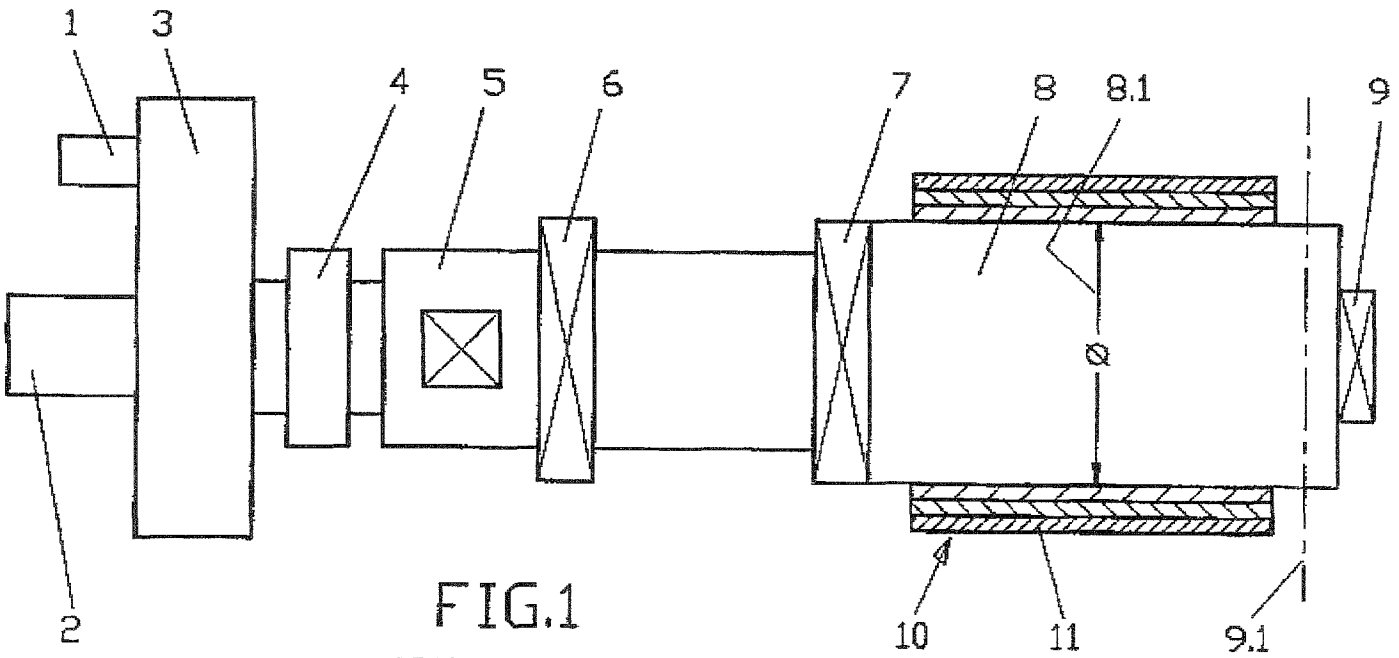
FIG.1 PRIOR ART
FIG. 1 shows a longitudinal partial section of a prior-art coiler mandrel.
Figure 2:
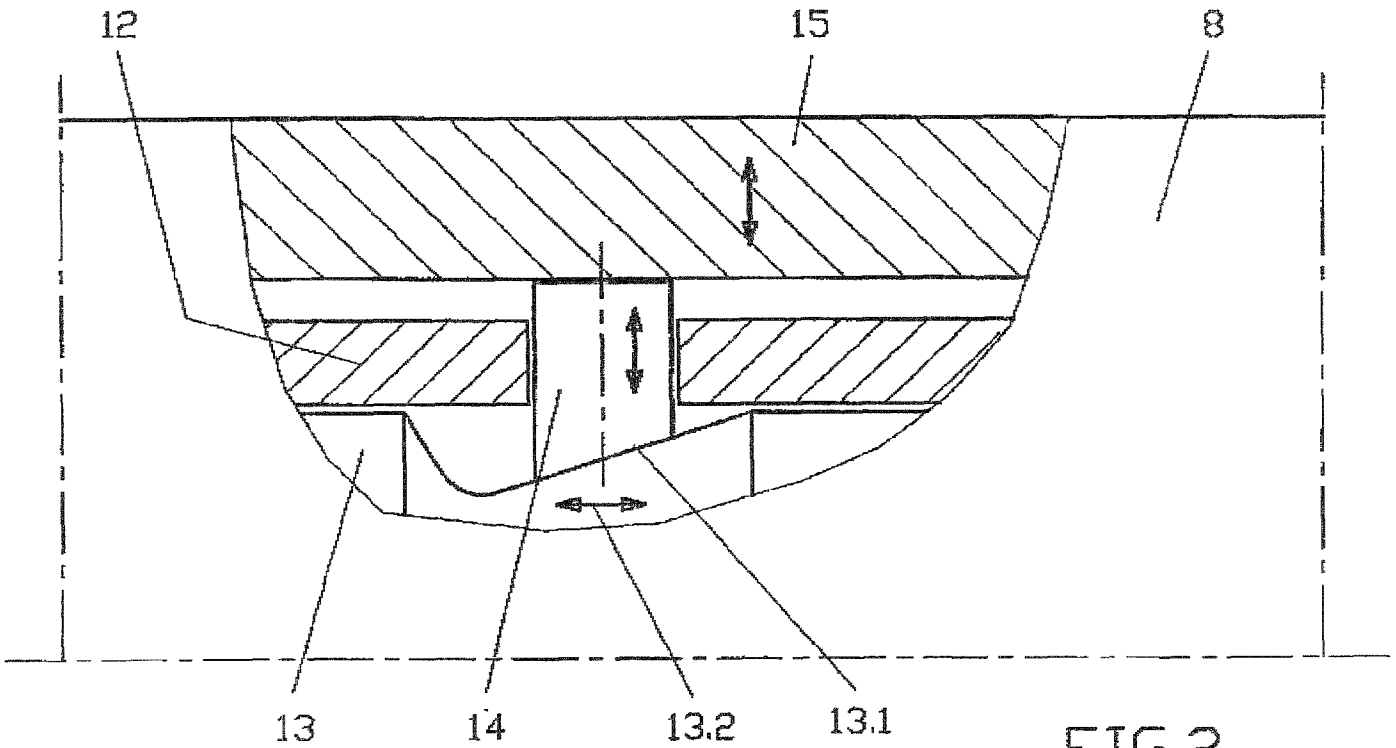
FIG.2 PRIOR ART
FIG. 2 shows a longitudinal partial section of the coiler mandrel according to FIG. 1 with an expanding segment, mandrel body, and tie rod.

The elimination of the oblique plane 13.1 of the type that is known from the prior art and is illustrated in FIG. 2 means that grease lubrication for it is also eliminated. With the coiler mandrel of the invention, it is now possible for it to be cooled by supplying it with water. A suitable water flow system makes it possible to clean or rinse off the coiler mandrel continuously and thus prevent fouling.

LIST OF REFERENCE NUMBERS 1 motor
2 transmission
3 clutch
4 hydraulic cylinder
5 rear mandrel bearing
6 front mandrel bearing
7 coiling section
8 mandrel step bearing
9 metal strip
10 windings
11 mandrel body

12 expanding bar
13 pressure member
14 segment
15 cylinder
100 coiler mandrel
101 motor
103 clutch
104 hydraulic cylinder
106 front mandrel bearing
107 rear mandrel bearing
110 windings
111 metal strip
115 segment
116 cylinder
117 position sensor
117.1 cable
118 cable conduit
119 mandrel body
120 coiling section
121 balancing cylinder
121.1 cylinder piston
121.2 cylinder cover
122 medium supply line
123 rotary transformer

The invention claimed is:

1. A method for coiling metal strip onto a coiler with a mandrel body, a plurality of radially expandable segments arranged around the mandrel body, and a plurality of radially acting hydraulic cylinders by which the segments can be moved in a radial direction, the method comprising the steps of: coiling metal strip around the segments; and individually controlling each cylinder of the plurality of cylinders to act in the radial direction so as to move the segments in the radial direction.

2. The method in accordance with claim 1, wherein each cylinder of the plurality of cylinders is individually controlled to a same predetermined set position.

3. The method in accordance with claim 2, wherein a force control system is subordinate to a position control system.

4. The method in accordance with claim 1, wherein each cylinder of the plurality of cylinders is automatically controlled to a predetermined set pressure or a predetermined set force.

5. The method in accordance with claim 4, wherein a position control system is subordinate to a pressure or force control system.

6. The method in accordance with claim 1, wherein a correlation of tensile force in the metal strip to a expansion of the coiler mandrel is produced by setting a motor torque.

7. The method in accordance with claim 2, wherein each cylinder is individually controlled to a same radial distance from a longitudinal axis of the coiler mandrel.

8. A coiler mandrel for winding metal strip, comprising:

a mandrel body;

a plurality of radially expandable segments arranged around the mandrel body;

a plurality of radially acting hydraulic cylinders arranged radially beneath the segments so as to move the segments in the radial direction; and an automatic control device connected to the hydraulic cylinders for individually controlling each of the hydraulic cylinders.

9. The coiler mandrel in accordance with claim 8, further comprising an associated position sensor arranged in each cylinder.

10. The coiler mandrel in accordance with claim 9, further comprising balancing cylinders and pressure sensors, a respective one of the pressure sensors being arranged in each cylinder and/or each balancing cylinder.

11. The coiler mandrel in accordance with claim 10, wherein each balancing cylinder is connected with an associated one of the segments.

12. The coiler mandrel in accordance with claim 8, wherein the automatic control device has a synchronizing device for synchronizing predetermined setpoint values for the individually controlled hydraulic cylinders.

13. The coiler mandrel in accordance with claim 10, further comprising a medium supply line arranged to supply the hydraulic cylinders and the balancing cylinders with a hydraulic medium.

14. The coiler mandrel in accordance with claim 8, further comprising a medium supply line arranged to supply the coiler mandrel with a medium for simultaneously cooling and cleaning components of the coiler mandrel.

15. The coiler mandrel in accordance with claim 14, wherein the medium supply line is arranged to also supply lubricant to points of lubrication, and further comprising a rotary transformer arranged to supply measuring devices with current and/or voltage.

16. The coiler mandrel in accordance with claim 11, wherein each balancing cylinder is positively connected with the associated segment.

17. The coiler mandrel in accordance with claim 11, wherein each balancing cylinder is frictionally connected with the associated segment.

* * * * *

UNITED STATES PATENT AND TRADEMARK OFFICE

CERTIFICATE OF CORRECTION

PATENT NO. : 8,523,099 B2
APPLICATION NO. : 13/001457
DATED : September 3, 2013
INVENTOR(S) : Kipping et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 219 days.

Signed and Sealed this
Fifteenth Day of September, 2015

Michelle K. Lee

Michelle K. Lee
*Director of the United States Patent and Trademark Office*